US008733569B2

(12) United States Patent
Langh

(10) Patent No.: US 8,733,569 B2
(45) Date of Patent: May 27, 2014

(54) TRANSPORT FRAME

(75) Inventor: Hans Langh, Piikkio (FI)

(73) Assignee: Oy Langh Ship Ab, Piikkio (FI)

( * ) Notice: Subject to any disclaimer, the term of this patent is extended or adjusted under 35 U.S.C. 154(b) by 138 days.

(21) Appl. No.: 13/377,639

(22) PCT Filed: Jun. 10, 2010

(86) PCT No.: PCT/FI2010/050479

§ 371 (c)(1),
(2), (4) Date: Dec. 12, 2011

(87) PCT Pub. No.: WO2010/142854

PCT Pub. Date: Dec. 16, 2010

(65) Prior Publication Data

US 2012/0091129 A1 Apr. 19, 2012

(30) Foreign Application Priority Data

Jun. 12, 2009 (FI) ..... 20095670

(51) Int. Cl.
*B65D 88/00* (2006.01)

(52) U.S. Cl.
USPC ..... 220/1.5; 220/4.33; 220/4.34; 220/639; 220/646

(58) Field of Classification Search
CPC ..... B65D 88/00; B65D 88/12; B65D 88/121–88/124; B65D 88/126; B65D 90/00; B65D 90/02; B65D 90/54
USPC ..... 217/36; 220/1.5, 4.33–4.34
IPC ..... B65D 88/00, 88/12, 88/126, 90/00, B65D 90/02, 90/54
See application file for complete search history.

(56) References Cited

U.S. PATENT DOCUMENTS 3,478,919 A * 11/1969 Turpen ..... 220/324
3,750,826 A * 8/1973 Donath et al. ..... 220/324
3,801,146 A * 4/1974 Donath et al. ..... 292/218

(Continued)

FOREIGN PATENT DOCUMENTS

CN 1093072 C 10/2002
CN 101168403 4/2008

(Continued)

OTHER PUBLICATIONS

International Search Report dated Oct. 1, 2010, corresponding to PCT/FI2010/050479.

(Continued)

*Primary Examiner* — Mickey Yu
*Assistant Examiner* — Brijesh V. Patel
(74) *Attorney, Agent, or Firm* — Young & Thompson

(57) ABSTRACT

A transport frame includes a body (1) having walls and a detachable roof (8) arranged on top of the body (1). The roof (8) includes a top surface (9) and side walls (10) extending downward from the top surface (9) and having an essentially vertical dimension. The roof is locked in place with a locking element. The locking element has an operating handle (12) and a vertical bar (13) extending essentially downward from the operating handle (12) toward the wall of the body (1). With the operating handle (12), the locking element is adapted to be set to its locked position and open position, and the operating handle (12) is arranged to be used from the top surface (9) of the roof (8).

12 Claims, 3 Drawing Sheets

(56) References Cited

U.S. PATENT DOCUMENTS

| | | | | |
|---|---|---|---|---|
| 6,027,291 | A * | 2/2000 | Sain et al. | 410/35 |
| 6,210,088 | B1 * | 4/2001 | Crosby | 410/35 |
| 6,364,153 | B1 * | 4/2002 | Petzitillo et al. | 220/812 |
| 6,422,409 | B2 | 7/2002 | Kofod | |
| 6,592,155 | B1 * | 7/2003 | Lemley et al. | 292/7 |
| 2001/0035411 | A1 * | 11/2001 | Kofod | 220/7 |
| 2006/0043090 | A1 * | 3/2006 | Ferrini | 220/6 |
| 2007/0151971 | A1 * | 7/2007 | Petzitillo et al. | 220/1.5 |
| 2007/0194017 | A1 * | 8/2007 | Markwell | 220/1.5 |
| 2010/0102574 | A1 * | 4/2010 | Brewster et al. | 292/229 |
| 2012/0000906 | A1 * | 1/2012 | Langh | 220/1.5 |
| 2012/0087717 | A1 * | 4/2012 | Langh | 403/84 |

FOREIGN PATENT DOCUMENTS

| | | | |
|---|---|---|---|
| CN | 101168403 | A * | 4/2008 |
| CN | 201224581 | Y * | 4/2009 |
| DE | 1586749 | | 8/1970 |
| FI | 20075146 | | 8/2008 |
| FR | 2730710 | | 8/1996 |
| GB | 1274300 | | 5/1972 |
| JP | 348082221 | U | 10/1973 |
| WO | 00/30945 | | 6/2000 |
| WO | 0183329 | A1 | 11/2001 |
| WO | 2006/021734 | | 3/2006 |

OTHER PUBLICATIONS

Finnish Search Report, dated May 6, 2010, in Application No. 20095670.

Chinese Office Action, dated Nov. 15, 2013, from corresponding CN application.

Extended European Search Report, dated Jan. 2, 2014, from corresponding EP application.

* cited by examiner

TRANSPORT FRAME

BACKGROUND OF THE INVENTION

The invention relates to a transport frame with a body having walls and a detachable roof arranged on top of the body.

For instance goods transport containers may be equipped with an openable roof to enable loading and unloading of goods being transported from the top by means of a crane. The roof of the container may be locked in place for instance by means of latches or clasps arranged on the top edge of the container. One such solution is shown in publication FR 2 730 710.

Publication WO 2006021734 presents fastening members for fastening the roof of a container. The fastening members consist of a container-high bar with a handle fastened to the bottom part thereof for turning the bar and of a horizontal part which, when the handle is turned, turns on top of a bottom flange of an I beam in the roof module, thus, locking the roof module to place.

Publication FI 20075146 presents a container roof locking arrangement with a horizontal part preventing the rising up of the container roof and a bar arranged to extend from the horizontal part toward the bottom. At the bottom end of the vertical bar, a handle is arranged for operating the locking arrangement. At one end, the handle is fastened to the wall of the container in such a manner that the handle is turnable relative to its fastening point and movable in the vertical direction. At its bottom end, the vertical bar is fastened to the handle in such a manner that the fastening point of the bar is at a distance from the wall mounting shaft of the handle, whereby pressing the handle downward pulls the bar downward. The fastening point of the vertical bar is located on a different vertical axis and lower than the fastening point of the handle as seen in the locking position.

BRIEF DESCRIPTION OF THE INVENTION

It is an object of the invention to provide a novel transport frame.

The transport frame of the invention is characterised in that the roof comprises a top surface and side walls extending downward from the top surface and having an essentially vertical dimension, and that the transport frame has a locking means for locking the roof to the body, the locking means comprising an operating handle and a vertical bar extending essentially downward from the operating handle toward the wall of the body, the operating handle being used to arrange the locking means to its locked position and open position and being arranged to be used from the top surface of the roof.

The idea of the invention is that the transport frame has a body having walls and a roof arranged on top of the body. The roof comprises a top surface and side walls extending downward from the top surface and having an essentially vertical dimension. The roof is locked in place with a locking means having an operating handle for setting a locking member into its locked position or open position and the operating handle being arranged to be used from the top surface of the roof. The locking means has a vertical bar extending essentially downward from the handle toward the wall of the body. In such a transport frame, the total height of the transport frame wall is formed partly of a wall of the body and partly of a wall of the roof. When loading goods to be transported to the transport frame, the roof is lifted off, whereby the wall height of the transport frame comprises only the height of the body wall, which is lower than the total height of the frame. This type of lower wall does not damage as easily as when loading goods into a transport frame or container having higher walls. Further, in spite of the essentially vertical side wall of the roof, the locking can be opened from the top surface of the roof, whereby transport frames loaded side by side into a ship, for example, can easily be opened from their roofs, because when opening the roof locking, there is no need to open anything from the side of the transport frame.

BRIEF DESCRIPTION OF FIGURES

The invention will be described in greater detail in the attached drawings, in which.

DETAILED DESCRIPTION OF THE INVENTION

Figure 1:
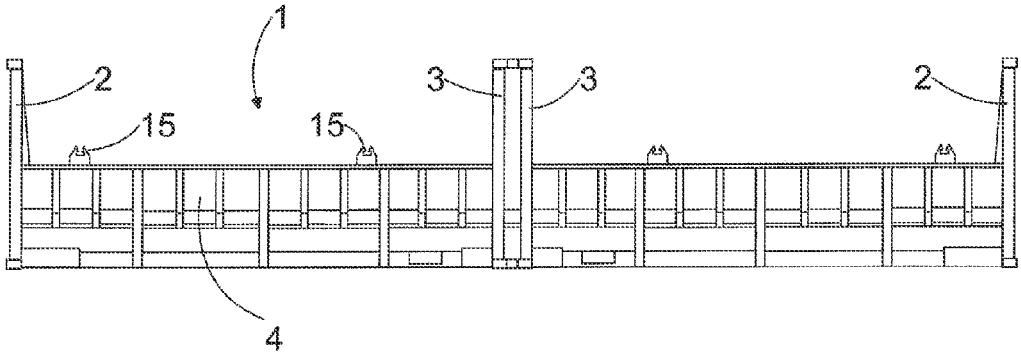
FIG. 1 is a schematic side view of a body of a transport frame.

FIG. 1 shows the body 1 of a transport frame. The length of the transport frame is 40 feet, that is, approximately 12.2 m, which corresponds to the length of a standard container. The width of the transport frame is 8 feet, that is, approximately 2.4 m, which corresponds to the width of a standard container. The height of corner posts 2 and, thus, the height of the entire frame is approximately 2.59 meters. The presented solution may naturally also be applied to transport frames of other sizes, such as to 10-, 20-, 30-, 45-, or 53-foot containers or frames.

Owing to the corner posts 2, a container may be placed on top of the transport frame. In the middle of the transport frame, there are two pairs of middle posts 3. Owing to the middle posts 3 and corner posts 2, two containers may be placed on top of the transport frame, the containers having a length that is half the length of the frame.

The corner post pairs and, correspondingly, the middle post pairs may, if necessary, be connected with a horizontal or lattice structure. If the posts are made sufficiently rigid, these reinforcement structures are not needed.

The free ends of the corner posts 2 and middle posts 3 have fastening members for fastening members located in the corners of containers to be arranged on top of the posts. The containers lock into the fastening members with standard-type fastening arrangements, so the structure of the fastening arrangement is not described in more detail.

The transport frames are fastened with fastening arrangements to a platform below them. The fastening arrangement may comprise for example a fastening means fastened to the bottom corner of the transport frame for locking to a base, in which case it is a locking means. The mounting base may be a ship's tween-deck or the bottom of the cargo space of a ship or the cargo deck of a ship, for instance. Further, the mounting base may be a pallet or the like of another transport means, such as truck or railway carriage, intended for the transport frame. The fastening arrangement structure will not be described in more detail in this context, because a fastening arrangement may be used that is known and usually used in fastening conventional containers to a transport means. All corners of the transport frame have a fastening means known to be used in containers. The fastening means is part of said fastening arrangement. The fastening means may also be used to connect together containers or transport frames placed on top of each other.

Figure 2:
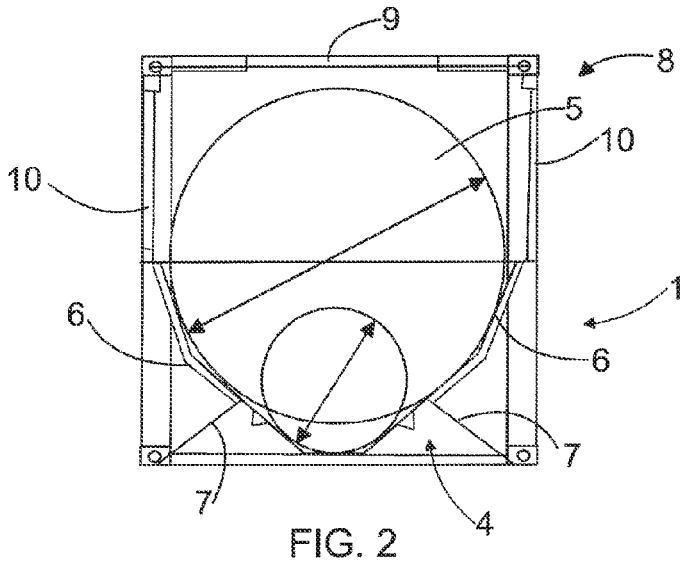
FIG. 2 is a schematic sectional end view of a transport frame.

As shown in FIG. 2, the transport frame comprises a trough 4 for reels 5. The trough 4 forms a cradle for the reels 5 and forms a uniform surface that extends along the entire length of the frame. The trough 4 is formed by bevelled surfaces 6. The bevelled surfaces 6 form support surfaces that provide lateral support for the reels 5. The bevelled surfaces 6 are designed to provide optimum support for reels of different sizes, which the circles of various sizes drawn in the figure illustrate. The diameter of the largest circle is approximately 2100 mm and that of the smallest is approximately 900 mm. The bevelled surfaces 6 of the trough are initially at an approximately 100° angle to each other and finally at a 40° angle to each other. The degrees may also differ from these and they may be defined according to the shape and size of the reel. The shape and height of the bevelled surfaces 6 are arranged such that the reel 5 remains in the cradle even without fastening straps.

Reference number 7 in FIG. 2 marks two longitudinal supports below the trough 4 and extending from one end of the frame to the other. The weight caused by the reels 5 is transmitted from the longitudinal supports 7 to the bottom structure of the frame. There may also be transverse supports below the trough 4.

In this context, reels refer especially to heavy steel reels that are formed of coiled steel plates. Further, the reels may be any structurally cylindrical pieces, such as paper reels. The weight of a reel is typically 10 to 25 tons, but it may be even heavier than this.

The bevelled surfaces 6 form a wall of the body 1 of the transport frame. The walls of the transport frame body 1 are considerably lower than the posts 2 and 3, for example. A roof 8 is arranged on top of the transport frame body 1. When goods, such as reels 5, to be transported are loaded into the transport frame, the roof 8 is lifted away from the transport frame body 1. The wall of the transport frame is then quite low and is, thus, not easily damaged when the transport frame is loaded. If a reel 5, for instance, swings during loading, it does not necessarily at all hit the transport frame wall, if the reel has not yet been lowered into the trough 4 or close to the trough 4. The height of the wall of the body 1 may be for instance 30 to 70% of the height of the transport frame. The height of the wall of the body 1 is preferably about half of that of the transport frame.

The roof 8 of the transport frame has a top surface 9 and side walls 10. The side walls 10 are essentially vertical and extend a distance downward from the top surface 9 of the roof. Thus, the roof 8 is dome-shaped. The top surface 9 of the roof 8 is substantially at the same level as the top surface of the posts 2 and 3, when the roof 8 is placed on top of the transport frame body 1. Thus, the wall of the body 1 forms one part and the side wall 10 of the roof 8 forms another part of the height of the side wall of the transport frame. The height of the side wall of the roof 8 may be for instance 30% to 70% of the height of the transport frame. The height of the roof is preferably about half of that of the transport frame.

Figure 3:
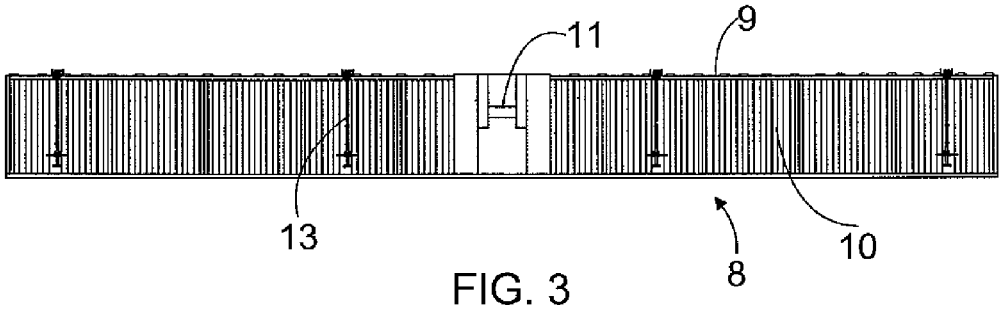
FIG. 3 is a schematic side view of a roof of a transport frame.
Figure 4:
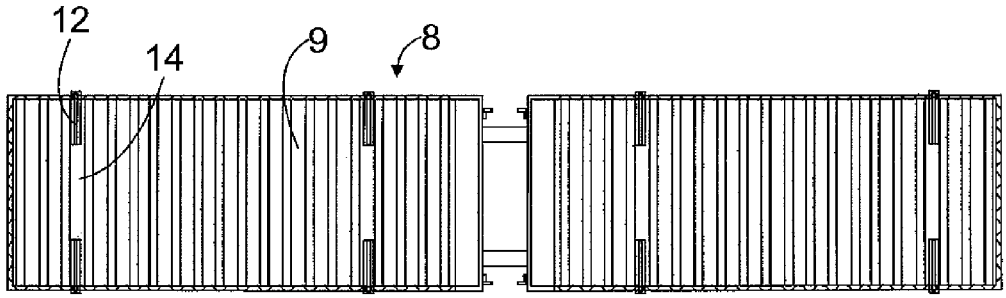
FIG. 4 is a schematic top view of a roof of a transport frame.
Figure 6:
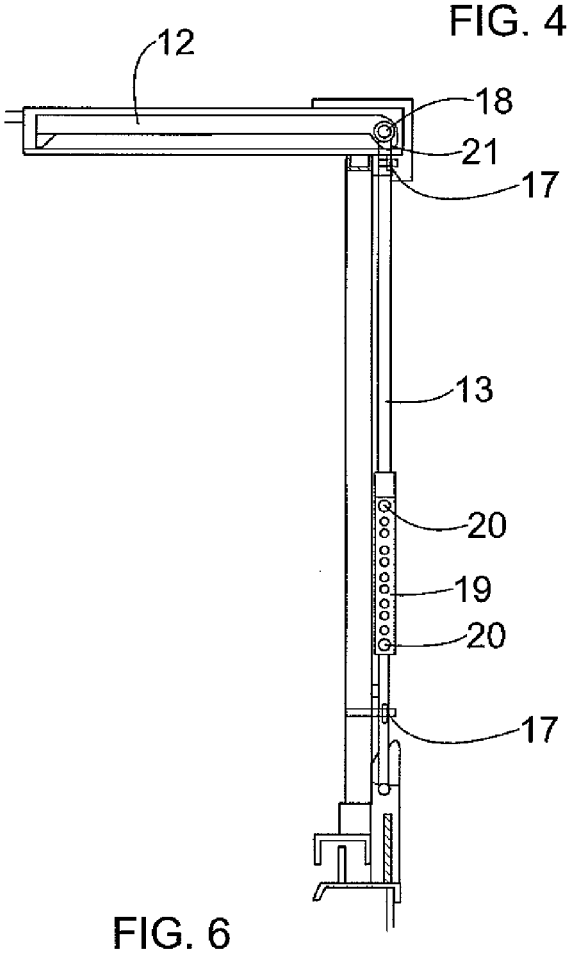
FIG. 6 is a schematic view of a cut along line A-A of FIG. 5.
Figure 5:
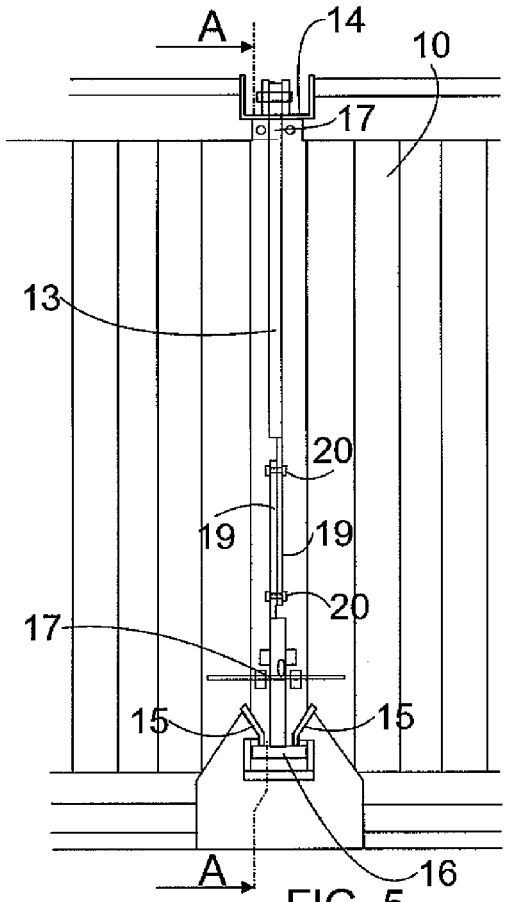
FIG. 5 is a schematic side view of a locking arrangement of a transport frame roof with the locking arrangement in its locked position.

As shown in FIG. 3, lifting points 11 are formed on the roof 8. At the lifting point 11, the roof 8 may be lifted for instance with a reel lifter intended for lifting reels. The lifting points 11 are formed in the mid-section of the length of the roof 8 at a distance of approximately 1.7 m from each other. The distance between the lifting points 11 can be selected relatively freely, but it is recommended that the lifting points are at a distance of 1.4 to 2 m from each other. When the roof 8 is lifted with a reel lifter, the jaws of the reel lifter are placed at the lifting points 11. Lifting protrusions at the bottom ends of the jaws are placed in a counter-piece at the lifting point 11, which thus settles on the lifting protrusions of the jaws.

The roof 8 is locked to the body 1 of the transport frame with a locking arrangement having an operating handle 12 and vertical bar 13. The operating handle 12 is arranged in the locked position of the locking means to be in the chute 14 formed on the top surface of the roof 8. The operating handle 12 then does not settle higher than the top level of the top surface of the roof 8, since this would cause problems in the use of the transport frame. Thus, the operating handle 12 can be used from the top surface 9 of the roof, and with the operating handle 12, the locking means is arranged to its locked position or open position. The vertical bar 13 extends essentially downward and toward the wall of the transport frame body 1. There is a locking lug 15 at the wall of the body 1. A counter-piece at the bottom end of the vertical bar 13 settles in the locking lug 15 in the locked position.

FIGS. 5 to 8 show the locking system in more detail. The counter-piece at the bottom end of the vertical bar 13 is a transverse part 16. The transverse part 16 extends into two directions from the bar 13, that is, the bottom end of the bar 13 is T-shaped. There are two lugs 15, whereby the transverse part 16 settles under each lug 15 and the bar 13 extends upward between the lugs 15. The bar 13 is fastened to the wall of the roof 8 with supports 17. The bar 13 is fastened with the supports 17 at both its top part and bottom part. In addition, the bar 13 may pass through the bottom of the chute 14. The supports 17 are formed in such a manner that the bar 13 can be rotated around its axis. In addition, the supports 17 do not as such prevent the bar 13 from moving in the vertical direction.

The operating handle 12 can turn around a turning pin 18. When the locking member is opened, that is, changed from its locked position shown in FIG. 5 to its open position shown in FIG. 7, the operating handle 12 is first turned around the turning pin 18 into an upright position. After this, the vertical bar 13 is turned around its axis approximately 90°, whereby the transverse part 16 turns from its position below the lugs 15 shown in FIG. 5 to the position shown in FIG. 7, where the transverse parts are between the lugs 15. In the position shown in FIG. 7, the locking member is open, and the roof 8 can be lifted away from the body 1 of the frame.

Figure 7:
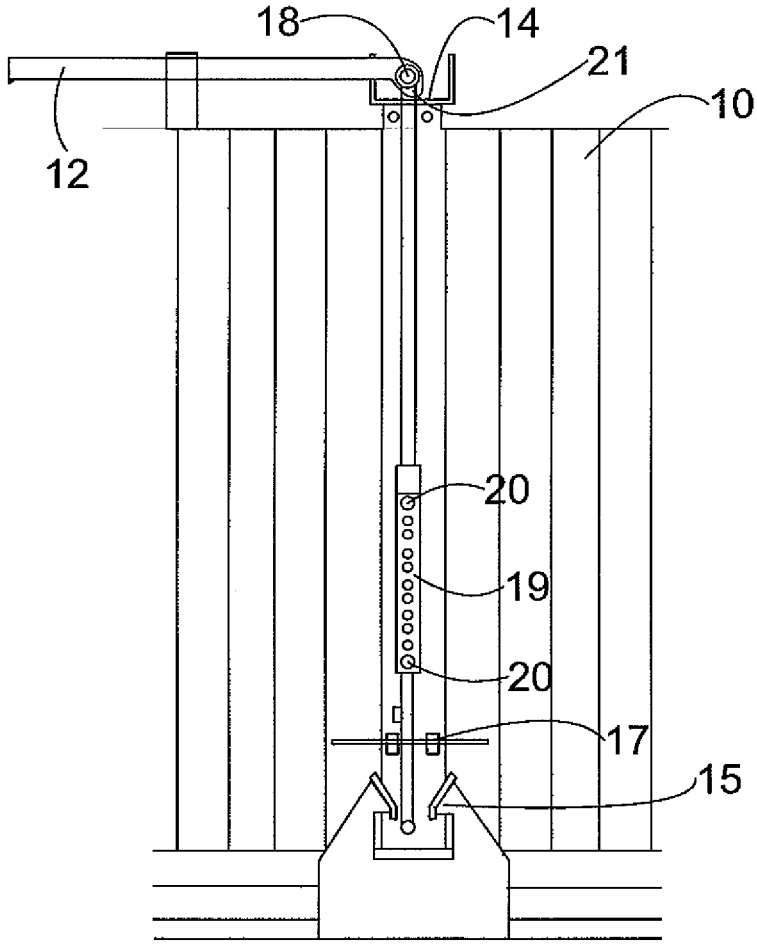
FIG. 7 is a schematic side view of a locking arrangement of a transport frame roof with the locking arrangement in its open position.

In the locked position, the operating handle 12 is in the chute 14 crosswise to the frame. When the locking is opened, the operating handle 12 is parallel to the edge of the frame on the edge of the roof 8 as shown in FIG. 7.

The vertical bar 13 comprises two bars 19 provided with holes. The bars 19 provided with holes are fastened to each other with bolts 20. By removing the bolts 20, it is possible to adjust the length of the vertical bar 13 by placing the required holes in different bars 19 provided with holes together and then arranging bolts 20 in them. This way, the tightness of the locking may be defined.

Figure 8:
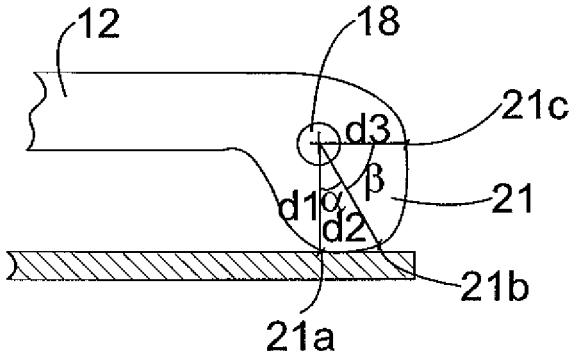
FIG. 8 is a schematic side view of a detail of a locking arrangement.

The operating handle 12 has a cam 21 essentially opposite to the turning pin 18 of the handle part. The shape of the cam 21 is shown in FIG. 8. When the operating handle is horizontal, that is, in the locked position, for instance, the chin 21*a* of the cam 21 is against the bottom of the chute 14. The cam 21 has a nose 21*b* in such a manner that the distance d1 of the chin 21*a* from the centre axis of the turning pin 18 is shorter than the distance d2 of the nose 21*b* from the centre axis of the turning pin 18. The cam 21 further has a forehead 21*c*, the distance d3 of which from the centre axis of the turning pin 18 is shorter than the distance d1 of the chin 21*a* from the centre axis of the turning pin 18.

Thus, when the handle part of the operating handle 12 is lifted, the nose 21*b* of the cam 21 presses more firmly against, the bottom of the chute 14, whereby the locking becomes tighter. After the operating handle 12 has been turned more than angle α shown in FIG. 8, the locking begins to loosen, and when the operating handle has been lifted directly up, that is, the forehead 21*c* is against the bottom of the chute 14, the transverse part 16 is at the same time slightly separate from the lugs and below them, whereby it is easy to turn the bar 13. Due to the shape of the cam 21, the operating handle 12 cannot by itself lift away from the locked position, and the turning of the operating handle initially tightens the locking. The angle α of FIG. 8 may be approximately 30°, for instance, and correspondingly angle β approximately 60°.

In some cases, the features described in this application may be used as such, regardless of other features. On the other hand, the features described in this application may also be combined to provide various combinations as necessary.

The drawings and the related description are only intended to illustrate the idea of the invention. The invention may vary in its details within the scope of the claims. Thus, the present solution may also be applied to other transport frames than those intended for transporting reels. The transport frame may be arranged to form a support for the goods being transported and is then not necessarily used as a transport container, whereby the transport frame need not be defined according to the container classification and heavier cargo or another transport frame of this type may be loaded on top of it than on a container according to the container classification.

The invention claimed is:

1. A transport frame comprising:

a body with a wall;

a detachable roof arranged on top of the body, the roof comprising a top surface and a side wall extending vertically downward from the top surface;

a locking arrangement locking the roof to the body, the locking arrangement comprising i) an operating handle arranged at the top surface of the roof and allowing use of the operating handle from the top surface of the roof, and ii) a vertical bar extending essentially downward from the operating handle toward the wall of the body, the operating handle being configured to position the locking arrangement in a locked position and in an open position.

2. The transport frame as claimed in claim 1, further comprising:

a counter-piece located at the bottom of the vertical bar; and at least one locking lug on the wall of the body, wherein, in the locked position, the counter-piece at the bottom of the vertical bar is settled in the at least one locking lug so that the at least one lug blocks the counter-piece and the roof is not liftable away from the body, and the operating handle is arranged to the roof.

3. The transport frame as claimed in claim 2, wherein, at least two locking lugs are arranged on the wall of the body, the counter-piece extends from the vertical bar into two directions in such a manner that the bottom end of the vertical bar is T-shaped, and in the locked position, the vertical bar is between the two locking lugs and the counter-piece is under the at least two lugs.

4. The transport frame as claimed in claim 3, further comprising:

a turning pin connecting the operating handle to the vertical bar, wherein, the locking arrangement is configured so that to change from the locked position to the open position, the operating handle i) first is turned, around the turning pin, from a horizontal position into an upright position, and ii) second is turned around an axis thereof to move the counter-piece from a first position below and vertically blocked by the two locking lugs to a second position where the counter-piece is between the two locking lugs and not vertically blocked by the two locking lugs.

5. The transport frame as claimed in claim 1, wherein the locking arrangement is arrangeable to the locked position and the open position by turning the vertical bar around a longitudinal axis thereof.

6. The transport frame as claimed in claim 5, wherein the operating handle is configured to turn the vertical bar around the longitudinal axis to move the locking arrangement between the locked position and the open position.

7. The transport frame as claimed in claim 1, further comprising:

a counter-piece located at the bottom of the vertical bar;

two locking lugs on the wall of the body; and a turning pin connecting the operating handle to the vertical bar, wherein, in the locked position, the counter-piece is settled under the two locking lugs with the two locking lugs blocking vertical movement of the counter-piece such that the roof is not liftable away from the body, and in the open position, the vertical bar is between the two locking lugs and the counter-piece is between the two locking lugs and not blocked by the two locking lugs so that the roof is vertically liftable away from the body, the locking arrangement is configured so that to change from the locked position to the open position, the operating handle i) first is turned, around the turning pin, from a horizontal position into an upright position, and ii) second is turned around an axis thereof to move the counter-piece from a first position below the two locking lugs to a second position where the counter-piece is between the two locking lugs and not vertically blocked by the two locking lugs.

8. The transport frame as claimed in claim 1, wherein, a height of the side wall of the roof is 30% to 70% of an overall height of the transport frame.

9. The transport frame as claimed in claim 8, wherein, the height of the side wall of the roof is about half the overall height of the transport frame.

10. The transport frame as claimed in claim 8, wherein, a distal lower end of the vertical bar is located vertically above a lowermost edge of the side wall of the roof.

11. The transport frame as claimed in claim 10, further comprising:

a counter-piece located at the bottom of the vertical bar;

two locking lugs on the wall of the body; and a turning pin connecting the operating handle to the vertical bar, wherein, in the locked position, the counter-piece is settled under the two locking lugs with the two locking lugs blocking vertical movement of the counter-piece such that the roof is not liftable away from the body, and in the open position, the vertical bar is between the two locking lugs and the counter-piece is between the two locking lugs and not blocked by the two locking lugs so that the roof is vertically liftable away from the body, the locking arrangement is configured so that to change from the locked position to the open position, the operating handle i) first is turned, around the turning pin, from a horizontal position into an upright position, and ii) second is turned around an axis thereof to move the counter-piece from a first position below the two locking lugs to a second position where the counter-piece is between the two locking lugs and not vertically blocked by the two locking lugs.

12. The transport frame as claimed in claim 8, further comprising:

a counter-piece located at the bottom of the vertical bar;

two locking lugs on the wall of the body; and a turning pin connecting the operating handle to the vertical bar, wherein, in the locked position, the counter-piece is settled under the two locking lugs with the two locking lugs blocking vertical movement of the counter-piece such that the roof is not liftable away from the body, and in the open position, the vertical bar is between the two locking lugs and the counter-piece is between the two locking lugs and not blocked by the two locking lugs so that the roof is vertically liftable away from the body, the locking arrangement is configured so that to change from the locked position to the open position, the operating handle i) first is turned, around the turning pin, from a horizontal position into an upright position, and ii) second is turned around an axis thereof to move the counter-piece from a first position below the two locking lugs to a second position where the counter-piece is between the two locking lugs and not vertically blocked by the two locking lugs.

* * * * *